US010450705B2

(12) United States Patent
Sadeghi

(10) Patent No.: US 10,450,705 B2
(45) Date of Patent: Oct. 22, 2019

(54) MAGNETIC LEVITATION TRAIN SYSTEM

(71) Applicant: HYPERLOOP TRANSPORTATION TECHNOLOGIES, INC., Culver City, CA (US)

(72) Inventor: Siavash Sadeghi, Culver City, CA (US)

(73) Assignee: HYPERLOOP TRANSPORTATION TECHNOLOGIES, INC., Culver City, CA (US)

( * ) Notice: Subject to any disclaimer, the term of this patent is extended or adjusted under 35 U.S.C. 154(b) by 160 days.

(21) Appl. No.: 15/439,110

(22) Filed: Feb. 22, 2017

(65) Prior Publication Data

US 2018/0237996 A1 Aug. 23, 2018

(51) Int. Cl.
*E01B 25/30* (2006.01)
*B61B 13/08* (2006.01)

(52) U.S. Cl.
CPC ..... *E01B 25/305* (2013.01); *B61B 13/08* (2013.01)

(58) Field of Classification Search
CPC ..... B60L 13/00; B60L 13/006; B60L 13/03; B60L 13/04; B60L 13/08; B60L 13/10; E01B 25/30; E01B 25/305; E01B 25/32
See application file for complete search history.

(56) References Cited

U.S. PATENT DOCUMENTS 6,633,217 B2 * 10/2003 Post ..... B60L 13/04 104/281

* cited by examiner

*Primary Examiner* — Robert J McCarry, Jr.
(74) *Attorney, Agent, or Firm* — Lucas & Mercanti, LLP

(57) ABSTRACT

Magnetic levitation train system comprising a plurality of rows of magnets being faced against a track onto which the magnetic levitation train system rides on, the plurality of rows of the magnets each being arranged in a Halbach array configuration, and further being arranged to cooperate to form a magnetic field exerted onto said track, wherein the magnets of each row of magnets are alternatively displaced with respect to each other according to a sinusoidal configuration.

5 Claims, 4 Drawing Sheets

MAGNETIC LEVITATION TRAIN SYSTEM

BACKGROUND OF THE INVENTION

1. Field of the Invention

The present invention relates generally to magnetic levitation systems for moving objects, and more specifically, to an improved magnetic levitation train system based on permanent magnets arranged in a particular Halbach array configuration.

2. Description of Related Art

Repelling magnetic forces are applied to levitate high-speed vehicles as trains. Said forces are produced by magnets placed on the train which interact with a passive conducting track to levitate the train. By utilizing passive magnetic levitation, a high lift-to-drag ration can be achieved, which results in a very low power consumption.

For producing said levitation forces it is known magnetic levitation train system composed by permanent magnets arranged in a Halbach array configuration. Halbach arrays represent a maximally efficient way to arrange permanent-magnet material when it is desired to produce a strong periodic magnetic field adjacent to the array. The effect of the cross-magnetized magnets in the array enhance the periodic magnetic field at the front face of the array and cancel it at the back face of the array.

There is a drawback of using a permanent magnet Halbach array configuration. The track onto which the train with the magnets moves have multiple slot openings that creates a force ripple causing vibration which reduces passenger comfort.

A solution for improving the force ripple can be based on decreasing or removing the slot openings of the track, however this is a non-desirable solution due to the increasing of the track cost. Other solution to reduce oscillation is using dampers, however this increase the friction of the train, raise the cost, and requires a change in the train design while reducing the whole reliability of the vehicle. In this sense a better solution is desirable for improving the force ripple decreasing oscillation.

SUMMARY OF THE INVENTION

It is an object of the present invention to provide a simple and reliable Halbach arrangement of permanent magnets for the magnetic levitation of high-speed trains which reduce the levitation and drag forces ripple while the average lifting and dragging force is maintained.

The magnetic levitation train system of the invention comprises a plurality of rows of magnets being faced against a track onto which the magnetic levitation train system rides on. The plurality of rows of the magnets each being arranged in a Halbach array configuration, and further being arranged to cooperate to form a magnetic field exerted onto said track. The magnets of each row of magnets are alternatively displaced with respect to each other according to a sinusoidal configuration.

Thus, using the proposed invention, the force ripple occurred due to the magnetic field exerted onto the track for the passive levitation of the train is reduced significantly while the average lifting and dragging force is maintained.

According to one preferred embodiment each row of magnets comprises an arrangement of four magnets. First and fourth magnets being placed at the ends of the row of magnets, and second and third magnets being placed between first and fourth magnets. The first and fourth magnet being placed in a same central position with respect to the row of magnets, the second magnet being placed in a backward position with respect to the row of magnets and the third magnet being placed in a forward position with respect to the row of magnets.

The second and third magnets are preferably displaced an equal distance with respect to the row of magnets.

The magnets have preferably 90° phase shift with respect to each other. Notwithstanding that fact the invention can be applied to any regular linear Halbach array configuration, for example the magnets may have 45° phase shift or 22.5° phase shift with respect to each other.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
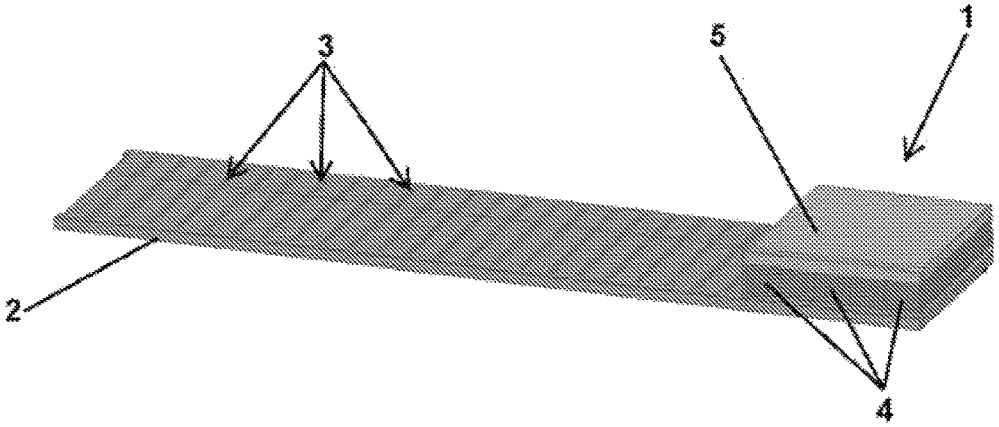
FIG. 1 shows an schematic view of a magnetic levitation train system onto a track with a prior art Halbach array permanent magnets configuration.

FIG. 1 shows a vehicle 1 such a train which is movable onto a track 2 with multiple slot openings 3. The vehicle 1 comprises a magnetic levitation train system having permanent magnets 4 cover by a metal sheet 5 which is placed below the vehicle 1. The permanent magnets 4 are faced against the track 2 and exert a magnetic field for levitation of the vehicle 1.

Figure 2:
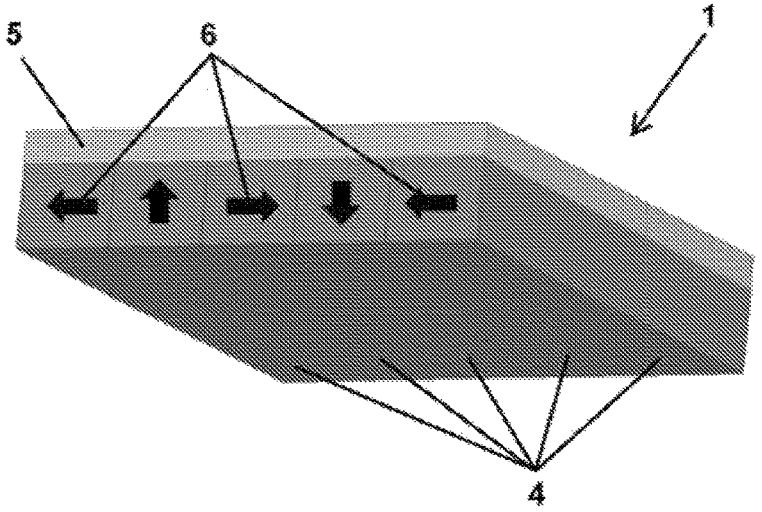
FIG. 2 shows a perspective bottom view of the magnetic levitation train system of FIG. 1.

The permanent magnets 4 shown in FIGS. 1 and 2 are arranged according to a prior art Halbach array configuration. The permanent magnets 4 are placed in rows of magnets 4 facing the track 2, with one bar shaped longitudinal magnet 4 per row. Each row of magnets 4 is shifted 90° with respect to an adjacent row of magnets 4.

In FIG. 2 it is represented the prior art Halbach array configuration with black arrows showing the magnetization vector 6 of each row of magnets 4. It is well known that magnetization vector 6 points to north pole of the magnet, thus magnetic field lines exit a magnet near its north pole and enter near its south pole. According to said prior art Halbach array configuration magnetic field lines on the upper side of the magnetic levitation train system, where the metal sheet 5 is placed, are cancelled, while magnetic field lines on the lower side of the magnetic levitation train system facing the track 2 are combined.

According to said configuration when vehicle 1 moves onto the track 2 permanent magnets 4 induce an electric current in the track 2. Due to the electric current a magnetic field is generated on the track 2 which is opposite to the magnetic field exerted by the permanent magnets 4. Thus, vehicle 1 levitates onto the track 2 being the lifting and dragging forces higher while the vehicle 1 speed increases.

The slot openings 3 of the track 2 generates a force ripple that creates an oscillation on the output of the lifting and dragging forces, occasioning a reduction of the passenger comfort.

Figure 3:
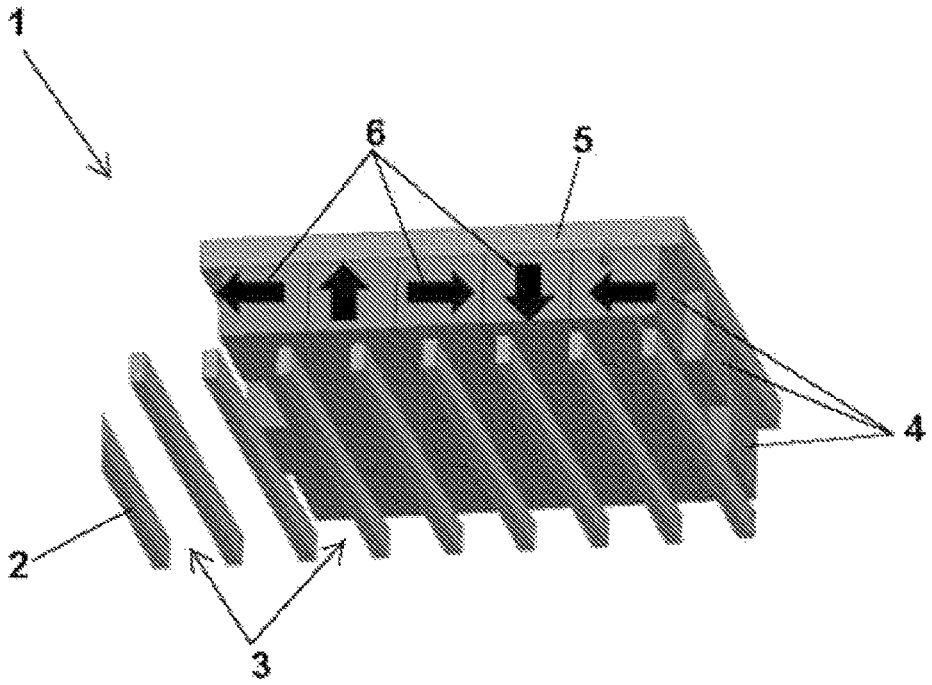
FIG. 3 shows an schematic view of a magnetic levitation train system onto a track with permanents magnets arranged according to the invention.

FIG. 3 shows a preferred embodiment of the magnetic levitation train system of the invention which reduces the oscillation generated by the slot openings 3 of the track 2. The system comprises a plurality of rows of magnets 4 covered by a metal sheet 5 and faced against a track 2 with multiple slot openings 3. The rows of magnets 4 are placed transversally to the length of the track 2, preferably the rows of magnets 4 are placed perpendicularly to the length of the track 2. The plurality of rows of the magnets 4 are arranged in a novel Halbach array configuration wherein the magnets 4 of each row of magnets 4 are alternatively displaced with respect to each other according to a sinusoidal configuration along the track width.

Figure 4:
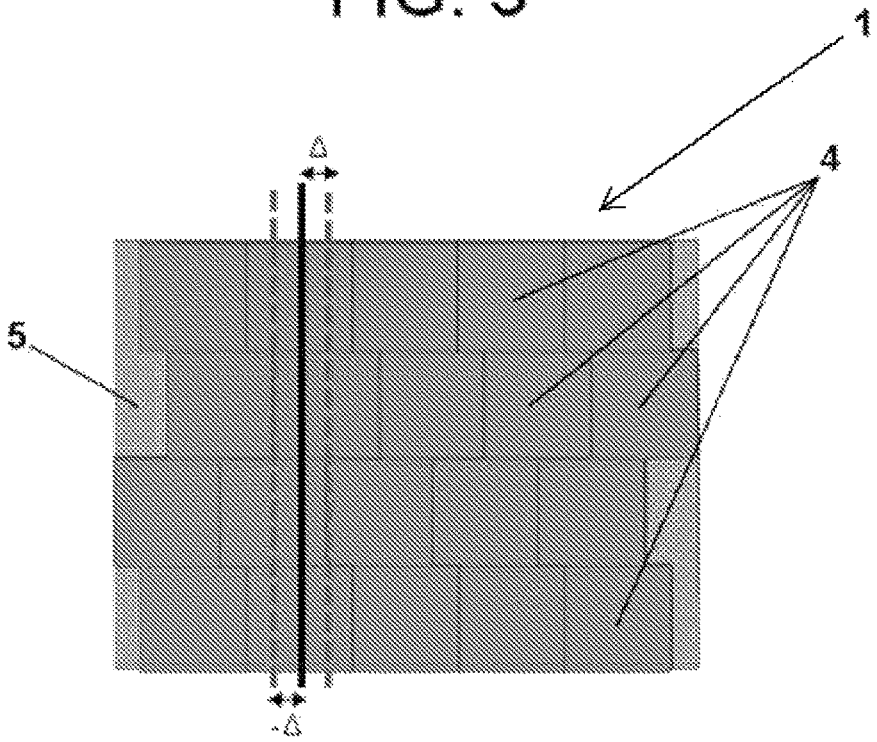
FIG. 4 shows a view of the magnetic levitation train system with a Halbach array permanent magnets configuration according to the invention.

In the example shown in FIG. 4, each row of magnets 4 comprises four permanent magnets 4. The magnets 4 are placed together without gaps between them. If showing a row of permanent magnets 4, a first and a fourth magnet 4 are placed at the ends of the row of magnets 4, while a second and a third magnet 4 are placed between the first and the fourth magnets 4. The first and the fourth magnet 4 are placed in a same central position with respect to the row of magnets 4, while the second magnet 4 is placed in a backward position with respect to the row of magnets 4 and the third magnet 4 is placed in a forward position with respect to the row of magnets 4, thus representing a sinusoidal configuration along the track width.

The second and third magnets 4 are displaced an equal distance with respect to the row of magnets 4. As shown in FIG. 4, longitudinal axis of the first and fourth magnets 4 are coaxial (represented in a black line), while the longitudinal axis of the second magnet 4 (represented in dashed line) is displaced $-\Delta$ with respect to the longitudinal axis of the first and fourth magnets 4 and the longitudinal axis of the third magnet 4 (represented in dashed line) is displaced $\Delta$ with respect the longitudinal axis of the first and fourth magnets 4.

It should be noted that the force ripple would be higher while the length of the slot openings 3 increases, thus the second and third magnet displacement with respect to the row of magnets 4 is selected depending on the track 2 and more specifically depending on the length of the slot openings 3 of the track 2.

Figure 5:
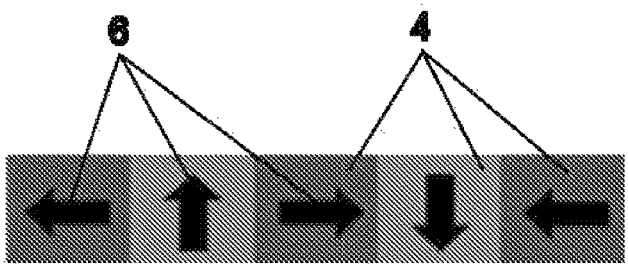
FIG. 5 shows a Halbach array permanent magnets configuration with magnets having 90° phase shift.
Figure 6:
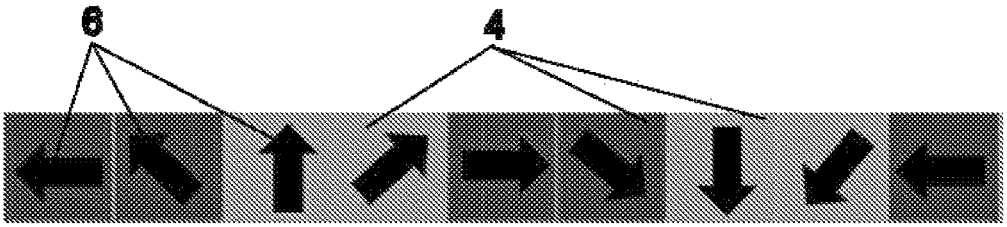
FIG. 6 shows a Halbach array permanent magnets configuration with magnets having 45° phase shift.

The invention can be applied to any regular linear Halbach array configuration. For example FIG. 5 shows an arrangement of five rows of magnets 4, where the magnets 4 of one row are shifted 90° degrees with respect to the magnets 4 of an adjacent row, thus the magnets 4 having a phase shift of 90°. FIG. 6 shows an arrangement of nine rows of magnets 4, where the magnets 4 of one row are shifted 45° degrees with respect to the magnets 4 of an adjacent row, thus the magnets 4 having a phase shift of 45°. Thus, shift between adjacent rows of magnets 4 could be arranged according to any regular linear Halbach array configuration.

Figure 7A:
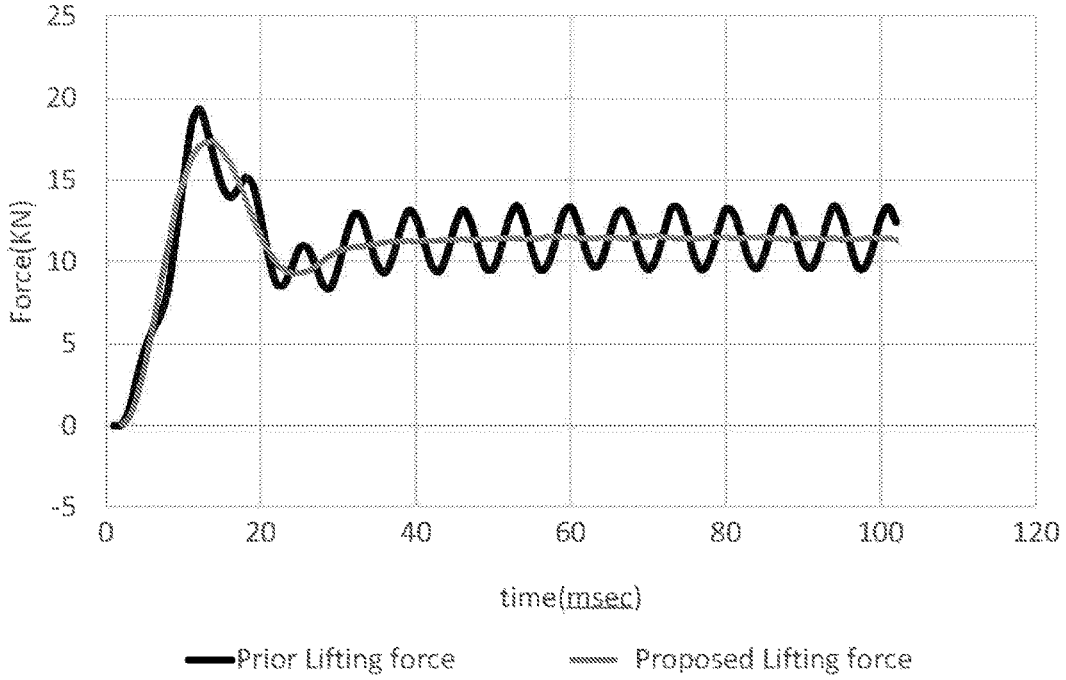
FIGS. 7*a* and 7*b* show respectively a comparative diagram of the lifting and dragging forces of the prior art Halbach array configuration and the proposed invention.
Figure 7B:
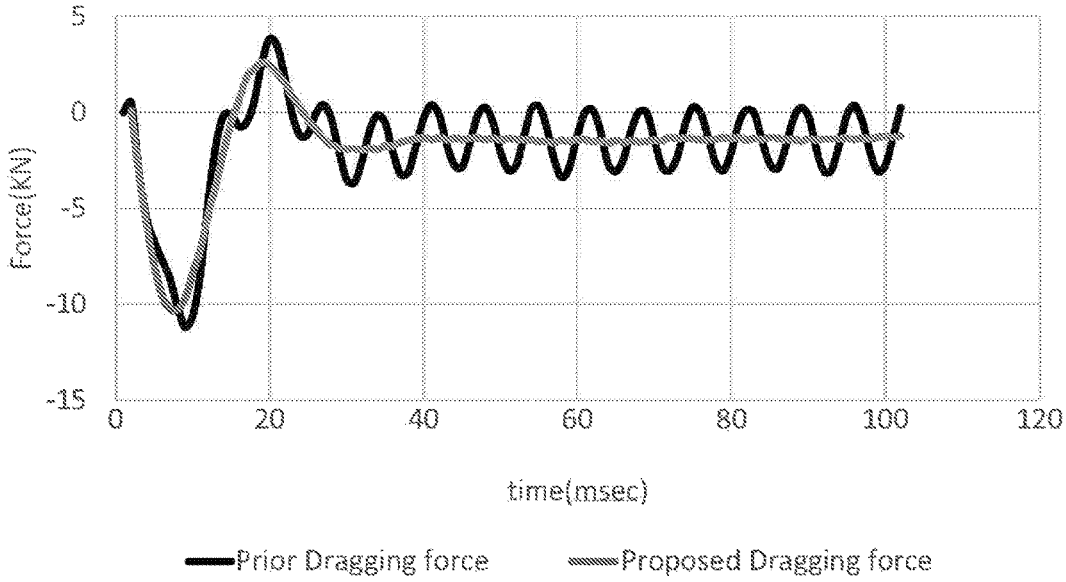

FIGS. 7*a* and 7*b* show the lifting and dragging forces for the prior art Halbach array configuration and the proposed invention. It can be seen that the lifting and dragging forces ripples are significantly reduced using the Halbach array configuration according to the invention.

The foregoing description of the invention has been presented for purposes of illustration and description and is not intended to be exhaustive or to limit the invention to the precise form disclosed. Many modifications and variations are possible in light of the above teaching. The embodiments disclosed were meant only to explain the principles of the invention and its practical application to thereby enable others skilled in the art to best use the invention in various embodiments and with various modifications suited to the particular use contemplated. The scope of the invention is to be defined by the following claims.

The invention claimed is:

1. A magnetic levitation system for a vehicle that moves on a track, the magnetic levitation system comprising:

a plurality of rows of magnets adapted to be attached to a vehicle that moves on a track, the plurality of rows of magnets being further adapted to be arranged to face the track, each respective row of magnets having first, second, third, and fourth magnets arranged in a Halbach array configuration;

wherein the first and fourth magnets share a first longitudinal axis that is perpendicular to the track, the second magnet has a second longitudinal axis that is parallel to and displaced a predetermined distance in a first direction from the first longitudinal axis, and the third magnet has a third longitudinal axis that is parallel to and displaced the predetermined distance in a second direction opposite the first direction from the first longitudinal axis.

2. The magnetic levitation train system of claim 1, wherein the second and third magnets are disposed between the first and fourth magnets.

3. The magnetic levitation system of claim 2, wherein successive magnets have a 90° phase shift with respect to each other.

4. The magnetic levitation system of claim 2, wherein successive magnets have a 45° phase shift with respect to each other.

5. The magnetic levitation system of claim 2, wherein successive magnets have a 22.5° phase shift with respect to each other.

* * * * *